United States Patent [19]

Bailey

[11] 4,034,917

[45] July 12, 1977

[54] VARIABLE ORIFICE FUEL INJECTION NOZZLE

[75] Inventor: John M. Bailey, Dunlap, Ill.

[73] Assignee: Caterpillar Tractor Co., Peoria, Ill.

[21] Appl. No.: 642,962

[22] Filed: Dec. 22, 1975

[51] Int. Cl.[2] ..... B05B 1/32; F02M 61/08

[52] U.S. Cl. ..... 239/453; 239/459; 239/533.7

[58] Field of Search ..... 239/89–91, 239/452, 453, 533, 584, 456, 459, 533.1, 533.2, 533.4, 533.5, 533.7–533.9, 87, 533.12

[56] References Cited

U.S. PATENT DOCUMENTS

| | | | |
|---|---|---|---|
| 2,297,487 | 9/1942 | L'Orange | 239/453 |
| 2,749,181 | 6/1956 | Maxwell et al. | 239/584 |
| 2,901,181 | 8/1959 | Bek | 239/533 X |
| 2,962,227 | 11/1960 | Whitehurst | 239/453 |

FOREIGN PATENT DOCUMENTS

| | | | |
|---|---|---|---|
| 552,873 | 2/1958 | Canada | 239/533 |
| 1,121,065 | 4/1956 | France | 239/533 |
| 900,977 | 10/1944 | France | 239/533 |
| 716,528 | 10/1966 | Italy | 239/533 |
| 658,443 | 10/1951 | United Kingdom | 239/452 |
| 633,857 | 12/1949 | United Kingdom | 239/533 |

*Primary Examiner*—Evon C. Blunk
*Assistant Examiner*—Andres Kashnikow
*Attorney, Agent, or Firm*—Phillips, Moore, Weisenberger, Lempio & Majestic

[57] ABSTRACT

There is disclosed a fuel injection nozzle of variable orifice design including a check valve to control fluid to the orifice from the fluid pressure supply to the nozzle assembly. The valve is operative together with a piston to control the relationship between the fluid pressure adjacent to the variable orifice and the effective open flow area of said variable orifice in a manner such as to cause a finely atomized fluid spray to be delivered from the orifice over a wide range of fluid flow rates.

1 Claim, 10 Drawing Figures

% FUEL INJECTION
100%

NOZZLE PRESSURE
a
P2
P1
VALVE
OPENING
PRESSURE

PINTLE MOTION
MAX. LIFT (OPEN)
CLOSED

VALVE DISC MOTION
MAX. LIFT (OPEN)
CLOSED
TIME

VARIABLE ORIFICE FUEL INJECTION NOZZLE

BACKGROUND OF THE INVENTION

This invention relates generally to a fuel injection nozzle for use in diesel engines which operate over a wide range of speed and load conditions, and pertains more particularly to a variable orifice type incorporating a pintle projecting into the orifice bore.

The following U.S. patents are representative of the pintle type injection valves known to the prior art: U.S. Pat. No. 2,860,010, issued Nov. 11, 1958 to Sennstrom et al; U.S. Pat. No. 3,045,920, issued July 24, 1962 to Hooker et al; and U.S. Pat. No. 3,444,886, issued May 20, 1969 to Bailey et al.

Such pintle type nozzles are known to the state-of-the-art, but a common problem with these nozzles is the difficulty in controlling the longitudinal motion, and therefore the orifice flow area, in response to the varying fluid pressure supplied to the nozzle assembly. This lack of control results in the pintle popping fully open, or at least an excessive amount initially or at low fluid discharge rates. The pintle also quite frequently undergoes an erratic motion, resulting in the orifice varying back and forth between large and small orifice openings during a single injection cycle. The large orifice opening causes a coarse fluid spray to be produced by the nozzle at low flow rates and pressures. This coarse spray results in poor combustion and waste of fuel.

SUMMARY OF THE INVENTION

It is therefore the principal object of this invention to provide a relatively simple means of limiting the orifice flow area with respect to the fluid pressure supplied to the nozzle from a fluid pump in such a manner that a finely atomized fluid spray will be produced under conditions for small amounts of fluid discharge, as for light load operation of a diesel engine.

Another object of this invention is to provide an injector valve that is operative to adjust the nozzle area in accordance with inlet flow of fuel to the valve.

In accordance with the present invention, an outwardly opening variable orifice valve is provided with differential pressure responsive means operative to position the valve in accordance with inlet flow and pressure to establish the orifice size.

BRIEF DESCRIPTION OF THE DRAWINGS

The above objects and advantages of the present invention will become apparent from the following specification when taken with reference to the accompanying drawings wherein.

FIGS. *4a–4d* are respectively, percent of fuel injected, nozzle pressure, pintle motion, and valve disc motion versus time curves for the nozzle during an injection cycle; and, FIGS. *5a–5c* are similar curves for the typical prior art system.

DETAILED DESCRIPTION OF PREFERRED EMBODIMENTS

Figure 1:
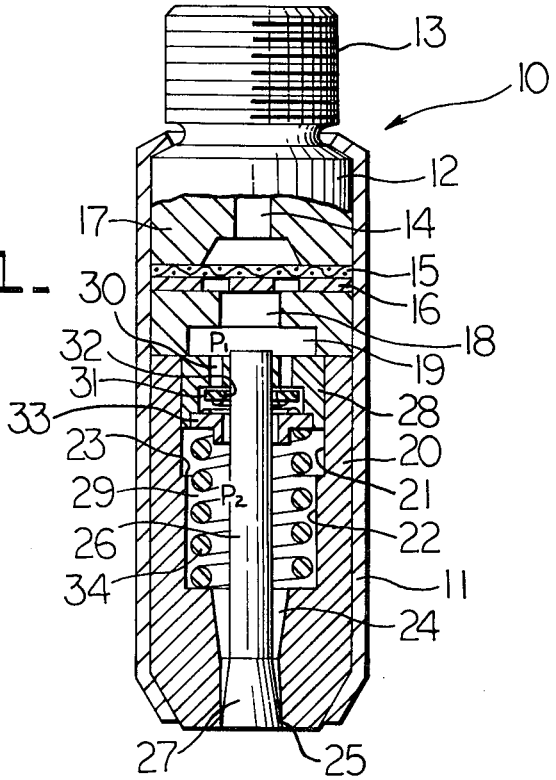
FIG. 1 is a sectional view of an injection nozzle incorporating a preferred embodiment of the present invention.
Figure 3:
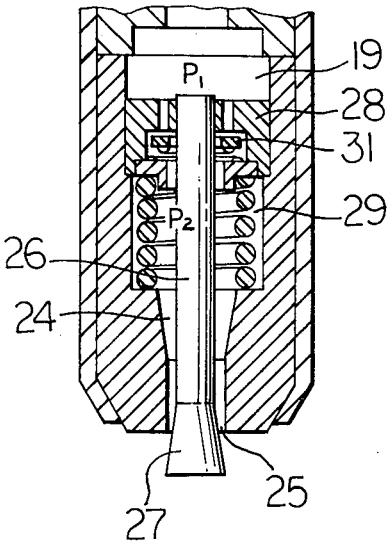
FIG. 3 is a view like FIG. 1, with the valve fully open.
Figure 2:
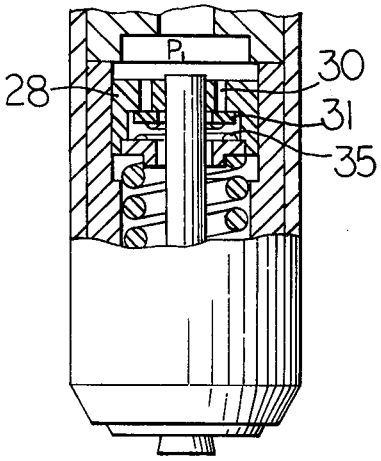
FIG. 2 is a view like FIG. 1, but with the valve of the nozzles in a partially open position.

With reference now to the drawings, and particularly to FIG. 1, there is illustrated a fuel injection nozzle generally designated by the numeral 10, constructed in accordance with the present invention, and comprising a jacket 11 encapsulating the various elements that go to make up the nozzle assembly. The nozzle includes an inlet housing portion 12, having suitable means such as threads 13 for connection of a supply line for supplying pressurized fuel from a supply pump (not shown) by way of an inlet passage 14. A screen and plate 15 and 16 are disposed between housing member 12 and a spacer 17 having a passage 18 and a chamber 19 formed therein.

A barrel 20 is provided with a step bore comprising a first cylindrical bore 21 of a first diameter in direct communication with a second bore 22 of a second diameter smaller than that of the first bore, and including a shoulder 23 formed therebetween. A passageway 24 communicates the bore with an outlet opening or orifice 25 which is normally positioned to open into a combustion chamber of an internal combustion engine.

An elongated valve stem or member 26, generally referred to as a pintle, includes tapered valve portion 27 at the lower end thereof, which cooperates with opening 25 to define an annular orifice.

A guide member 28 which may also be regarded as a piston is attached to the upper end of pintle member 26 such as by welding is reciprocally mounted in bore 21, and is operative therein to separate the inlet chamber 19 from what may be termed a control chamber 29 located below the guide 28 and defined by cylindrical bores 21 and 22. A plurality of passages or orifices 30, formed in guide 28, provide restricted communication of fuel from the inlet chamber 19 into the control chamber 29.

A disc member 31 is operative as a check valve for controlling orifices 30, and includes an enlarged bore 32 to permit fluid flow from the chamber 19 into chamber 29 when unseated as in FIG. 1. A disc member 33 retains valve member 31 in position, and is itself retained in position in any suitable manner such as by means of a spring 34, which is confined in chamber 29 and operative to force piston 28 upward and to urge valve means 27 into seating engagement within the orifice 25 to thereby close the injection valve of the nozzle assembly.

A very light spring member 35 is provided for acting on the valve member 31, urging it into closing relationship with orifice 30. With this lightspring having only sufficient strength to overcome the weight of disc 31, the closing of valve 31 occurs as soon as P2=P1.

The pressure in chambers 19 and 29 will vary in accordance or under the influence of a number of factors and accordingly act on piston 28 and the valve portion 27 of pintle 26 to effect opening or closing of the valve 27. The pressure in chamber 19, designated P1, and the pressure in chamber 29, designated P2, will normally be equal when the injector valve is in the closed position illustrated in FIG. 1.

OPERATION

Figures 4A, 4B, 4C, 4D:
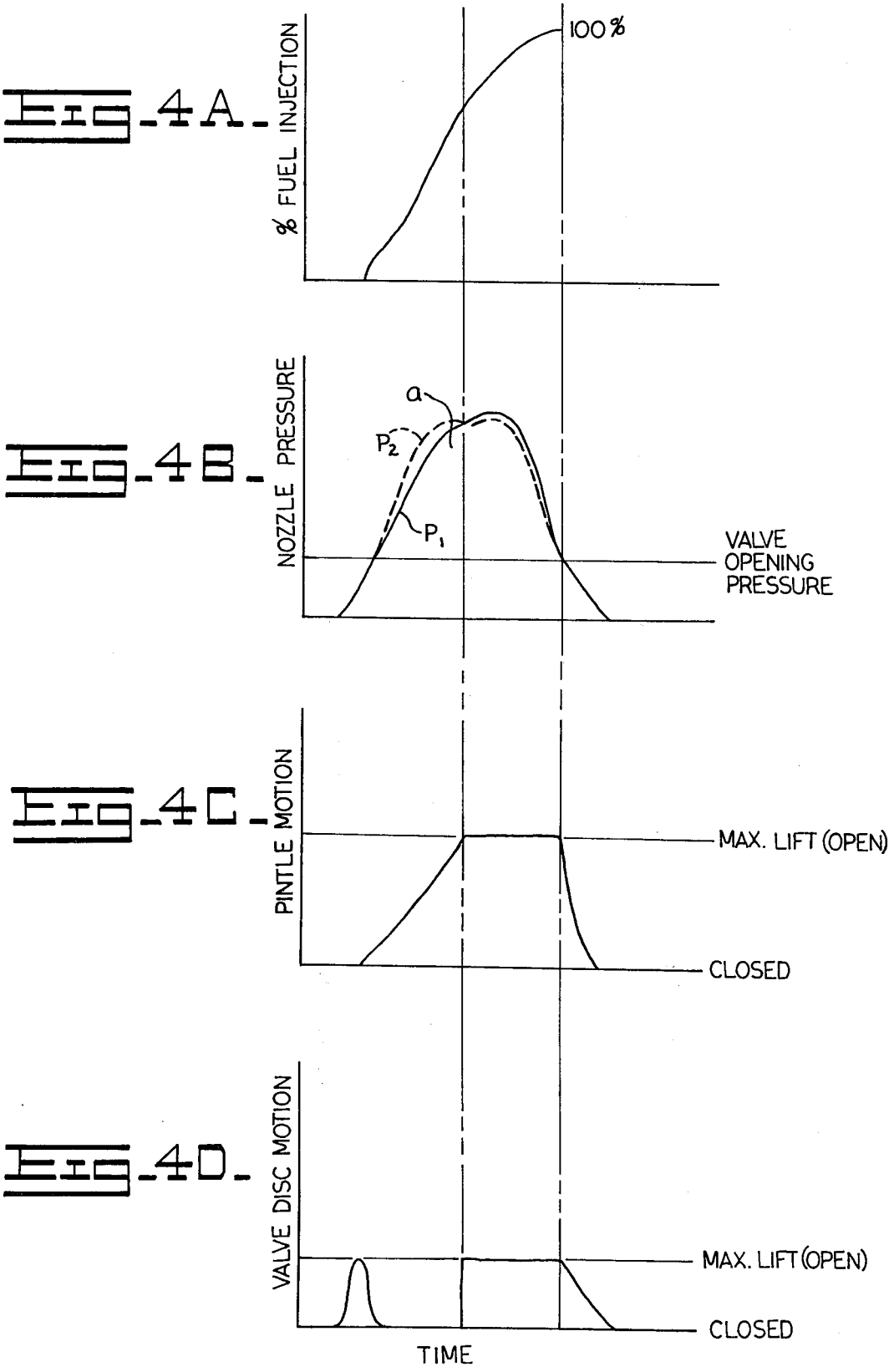

During the initial portion of the injection cycle, fluid pressure P1 in chamber 19 will be greater than the fluid pressure P2 in chamber 29 and the disc valve 31 will be opened as in FIG. 1. However, the pressure P2 quickly builds up to valve opening pressure (FIG. 4B) such that the pressure acting on the greater area of valve portion 27 begins to move the valve member downward and open (FIG. 4C), with the result that pressure P2 momentarily increases greater than pressure P1, (FIG. 4B) permitting valve 31 to close. With the passages 30 closed, valve 27 continues to open, but the amount of opening is now influenced or controlled by the differential pressure between P1 and P2 with P2 determined by the downward force resulting from P1 and the opening of the orifice 25 (FIG. 4C) through which fluid in control chamber 29 is being ejected. Any tendency of the valve 27 to overshoot toward the full position will be opposed by the pressure P2, which will be caused to increase (FIG. 4B) to oppose the overshooting. This tendency toward overshooting is due partially to the inertia of the valve means which includes the stem 26 and valve means 27, and partially due to the low spring force from spring 34 acting to keep the valve from opening. These conditions restricting the valve opening and increasing pressure P2, serve to provide a dampening effect on the rate of opening of valve element 27, resulting in a modulated and controlled opening thereof, as seen in FIG. 4C, and serve to provide more finely atomized fluid spray from the orifice over the injection cycle.

Thus, any tendency of the valve to overshoot to a full-open position will result in the check valve 31 closing (FIG. 4D) the orifices 30 because of the build-up in pressure or attempted back-flow of fluid from chamber 29 back to the upper side of the piston member 28. As fuel enters, it passes freely through the screen into chamber 19 from which it flows through orifices 30, unseats check valves 31 and sequentially charges chamber 29. When the combined pressure of chambers 19 and 29 creates sufficient force to overcome the seating force of spring 34, valve 26 will tend to open by shifting outwardly. This action due to the large area of piston 28 will result in a back flow of fuel through orifices 30 which with the assistance of spring 35 quickly closes check valve 31. The momentary build up of pressure in chamber 29 caused by movement of piston 28 thus acts to prevent overshooting of the valve. Fuel will discharge through orifice 25 at an optimum rate corresponding directly to movement and displacement of piston 28. Late in the injection period when orifice 25 is quite large the forces acting to open and close valve 26 will attain a balanced condition. In a state of equilibrium, valve 26 will not tend to overshoot, check valve 31 can again open, and additional fuel pressurized in the supply line will be able to pass and discharge through orifices 30 and 25.

Figure 5A:
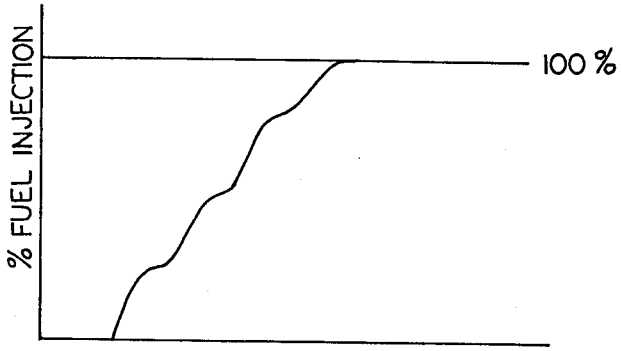
Fig-5A- PRIOR ART
Figure 5B:
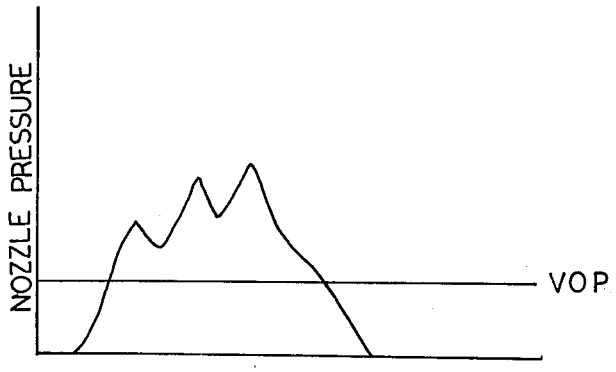
Fig-5B- PRIOR ART
Figure 5C:
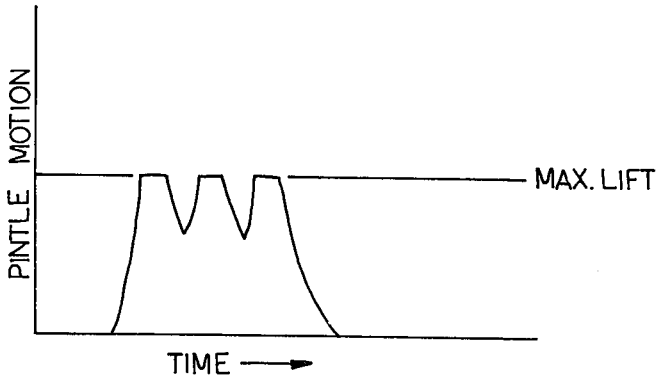
Fig-5C- PRIOR ART

It will be seen from a careful analysis of the operation of this valve especially as depicted in FIGS. 4A–4D, that the valve is operative to resist rapid opening thereof regardless of the upstream pressure and/or flow rate, and thus will automatically adjust itself to an optimum orifice setting to accommodate the quantity of fluid being supplied thereto from the supply pump. Since the quantity of fluid being supplied from the supply pump is controlled by a governor which is responsive to engine speed and load, this supply will be controlled generally by the engine demands. Thus, the present valve is responsive to the flow rate and pressure as well as the duration of that flow to adjust itself to accommodate that particular fuel flow setting. The valve functions to insure that at least the initial injection into the combustion chamber is finely atomized and thus provides a finely controlled optimum combustion. This operation is in contrast to the operation of the typical pintle type injection nozzle, the operation of which is illustrated in FIGS. 5A–5C. As illustrated, the prior art constructions result in a nozzle wherein the pintle or valve fluctuates or flutters, causing fluctuations in nozzle pressure and erratic injection.

While the present invention has been described with respect to specific embodiments, it is apparent that numerous changes and modifications may be made in the illustrated embodiments without departing from the spirit and scope of the present invention as defined in the appended claims.

What is claimed is:

1. A variable orifice fuel injection nozzle comprising:

a housing having a central bore;

an inlet opening communicating with said bore;

an outlet in said housing in communication with said bore and defining a valve seat;

an elongate stemmed pintle valve reciprocally mounted in said housing and operative to engage said seat to close said opening, and operative in conjunction with said opening to define a variable opening;

damping means comprising a piston fixedly connected to said pintle valve and reciprocally mounted in said bore between said inlet and outlet openings to damp the opening of said valve to a control rate proportional to fluid pressures developed within said housing;

restricted passage means in said piston to provide restricted communication of fluid from the inlet side of said piston to the outlet side thereof;

said stemmed pintle valve including a stem connected at one end to said piston means, and a tapered valve head formed its other end to engage said valve seat;

spring means bearing at one end against a shoulder formed into said bore and against the outlet side of said piston at the other end thereof to bias said valve into engagement with said seat; and check valve means permitting fluid flow through said restricted passage means from the inlet to the outlet side of said piston and preventing fluid flow from the outlet to the inlet side of said piston, said check valve means comprising a disc member surrounding said stem of said pintle valve adjacent the outlet opening of said restricted passage means, light spring means bearing against said disc member and a shoulder on said outlet side of said piston to bias said disc member into light engagement with the outlet side of said piston to cover said restricted passage means.

* * * * *